US008967264B2

(12) United States Patent
Nguyen

(10) Patent No.: US 8,967,264 B2
(45) Date of Patent: Mar. 3, 2015

(54) METHODS OF ENHANCING FRACTURING STIMULATION IN SUBTERRANEAN FORMATIONS USING IN SITU FOAM GENERATION AND PRESSURE PULSING

(71) Applicant: Halliburton Energy Services, Inc., Houston, TX (US)

(72) Inventor: Philip D. Nguyen, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 259 days.

(21) Appl. No.: 13/625,903

(22) Filed: Sep. 25, 2012

(65) Prior Publication Data

US 2014/0083695 A1 Mar. 27, 2014

(51) Int. Cl.
*E21B 43/267* (2006.01)

(52) U.S. Cl.
CPC ..... *E21B 43/267* (2013.01)
USPC ..... 166/308.1; 166/309; 166/280.2; 166/308.2

(58) Field of Classification Search
CPC ..... E21B 43/267
USPC ..... 166/307, 308.1, 308.2, 308.3, 308.5, 166/308.6, 309
See application file for complete search history.

(56) References Cited

U.S. PATENT DOCUMENTS

| | | | | |
|---|---|---|---|---|
| 4,714,114 | A | 12/1987 | Jones | |
| 4,982,793 | A | 1/1991 | Holtmyer et al. | |
| 5,122,549 | A | 6/1992 | Holtmyer et al. | |
| 5,366,015 | A | 11/1994 | Surjaatmadja et al. | |
| 5,575,335 | A | 11/1996 | King | |
| 5,893,383 | A | 4/1999 | Facteau | |
| 6,394,184 | B2 | 5/2002 | Tolman et al. | |
| 6,938,690 | B2 | 9/2005 | Surjaatmadja | |
| 6,992,048 | B2 * | 1/2006 | Reddy et al. | 507/202 |
| 7,025,134 | B2 | 4/2006 | Byrd et al. | |
| 7,114,560 | B2 | 10/2006 | Nguyen et al. | |
| 7,199,083 | B2 | 4/2007 | Zevallos | |
| 7,213,651 | B2 | 5/2007 | Brannon et al. | |
| 7,273,099 | B2 * | 9/2007 | East et al. | 166/280.1 |
| 7,287,594 | B1 | 10/2007 | Chatterji et al. | |
| 2007/0044965 | A1 | 3/2007 | Middaugh et al. | |
| 2007/0187096 | A1 * | 8/2007 | Pauls et al. | 166/280.1 |
| 2010/0065274 | A1 | 3/2010 | Haney et al. | |

FOREIGN PATENT DOCUMENTS

| | | | |
|---|---|---|---|
| WO | 2007110591 | A1 | 10/2007 |
| WO | 2014052085 | A1 | 4/2014 |

OTHER PUBLICATIONS

International Search Report and Written Opinion for PCT/US2013/060027 dated Nov. 22, 2013.

* cited by examiner

*Primary Examiner* — Zakiya W Bates
*Assistant Examiner* — Silvana Runyan
(74) *Attorney, Agent, or Firm* — McDermott Will & Emery LLP; Craig W. Roddy

(57) ABSTRACT

Methods of enhancing fracturing stimulation in subterranean formations using in situ foam generation and pressure pulsing. A jetting fluid comprising an aqueous base fluid is introduced into a subterranean formation to create or enhance at least one fracture therein. A fracturing fluid comprising an aqueous base fluid, a gelling agent, a proppant agent, a gas generating chemical, and a gas activator is introduced into the at least one fracture. Intermittent pressure pulsing is applied to the fracturing fluid to extend the at least one fracture.

20 Claims, No Drawings

METHODS OF ENHANCING FRACTURING STIMULATION IN SUBTERRANEAN FORMATIONS USING IN SITU FOAM GENERATION AND PRESSURE PULSING

BACKGROUND

The present invention relates to methods of enhancing fracturing stimulation in subterranean formations using in situ foam generation and pressure pulsing.

Subterranean wells (such as hydrocarbon producing wells, water producing wells, and injection wells) are often stimulated by hydraulic fracturing treatments. In hydraulic fracturing treatments, a viscous treatment fluid is pumped into a portion of a subterranean formation at a rate and pressure such that the subterranean formation breaks down and one or more fractures are formed. Typically, particulate solids, such as graded sand, are suspended in a portion of the treatment fluid and then deposited in the fractures. These particulate solids, or "proppant particulates," serve to prevent the fractures from fully closing once the hydraulic pressure is removed. By keeping the fracture from fully closing, the proppant particulates aid in forming conductive paths through which fluids may flow.

Traditional treatment fracturing fluids require substantial amounts of an aqueous base fluid to be introduced into the formation, often diluting treatment fluids and impairing hydrocarbon flow due to formation fluid retention. Traditional treatment fracturing fluids may also damage the formation by reducing its permeability to hydrocarbons due to fluid-induced swelling of the formation. Thus, achieving adequate penetration of a subterranean formation, particularly in low pressure and fluid sensitive formations, using traditional hydraulic treatment fluids is often difficult because efficient fracture creation or propagation requires high-quality fluid loss control and minimal damage to the formation.

Foamed treatment fluids have been used to overcome some of the problems related to traditional treatment fluids. As used herein, the term "foam" refers to a two-phase composition having a continuous liquid phase and a discontinuous gas phase. Foamed treatment fluids permit reduction in the amount of aqueous base fluid required. Foamed treatment fluids also tend to have superior fluid loss control properties. However, the effectiveness of foamed treatment fluids is dependent upon the quality of the foam (e.g., the quality of gas phase). The gas phase of foamed treatment fluids can easily collapse or breakdown in conditions present in subterranean formations, such as compressive stress, temperature, salinity, acidity, and the presence of oils, for example. Collapsed foamed treatment fluids are represented only by their liquid phase. Therefore, in fracturing operations, the liquid phase of a collapsed foamed treatment fluid may damage or leak into the fracture face, just like traditional treatment fluids. Therefore, a method of creating in situ foam generation for propagating fractures in a subterranean formation may be of benefit to one of ordinary skill in the art.

SUMMARY OF THE INVENTION

The present invention relates to methods of enhancing fracturing stimulation in subterranean formations using in situ foam generation and pressure pulsing.

In some embodiments, the present invention provides a method comprising: a) providing a jetting fluid comprising an aqueous base fluid; b) providing a fracturing fluid comprising an aqueous base fluid, a gelling agent, a proppant agent, a gas generating chemical, and a gas activator; c) introducing the jetting fluid into a subterranean formation to create or enhance at least one fracture therein; d) introducing the fracturing fluid into the at least one fracture; and e) applying intermittent pressure pulsing to the fracturing fluid to extend the at least one fracture and to deposit the proppant agent therein.

In other embodiments, the present invention provides a method comprising: a) providing a jetting fluid comprising an aqueous base fluid; b) providing a fracturing fluid comprising an aqueous base fluid, a gelling agent, a proppant agent, a gas generating chemical, a gas activator, a foaming agent, and a foam stabilizing surfactant; c) introducing the jetting fluid into a subterranean formation to create or enhance at least one fracture therein; d) introducing the fracturing fluid into the at least one fracture; and e) applying intermittent pressure pulsing to the fracturing fluid to extend the at least one fracture.

In still other embodiments, the present invention provides a method comprising: a) providing a jetting fluid comprising an aqueous base fluid; b) providing a first fracturing fluid comprising an aqueous base fluid, a gelling agent, a proppant agent, a gas generating chemical, and a gas activator; c) providing a second fracturing fluid comprising an aqueous base fluid, a foaming agent, and a foam stabilizing surfactant; d) introducing the jetting fluid into a subterranean formation to create or enhance at least one fracture therein; e) introducing the first fracturing fluid into the at least one fracture; f) applying intermittent pressure pulsing to the first fracturing fluid to extend the at least one fracture; and g) introducing the second fracturing fluid between the intermittent pressure pulsing of the first fracturing fluid.

The features and advantages of the present invention will be readily apparent to those skilled in the art upon a reading of the description of the preferred embodiments that follow.

DETAILED DESCRIPTION

The present invention relates to methods of enhancing fracturing stimulation in subterranean formations using in situ foam generation and pressure pulsing.

The methods of the present invention disclose controlled pulse fracturing methods capable of in situ foam generation to enhance the creation or propagation of fractures in subterranean formations. In situ foam generation ensures that the gas phase property of the foam will not collapse due to subterranean conditions, a problem that has in the past diminished the advantages of foamed treatment fluids. In addition, the in situ foam generation, allows for the use of reduced volumes of aqueous base fluid required, thus reducing fluid loss and potential damage to the subterranean formation. Pressure pulsing the foamed treatment fluids additionally increases the surface area of the fracture available for contact with the treatment fluids.

The pressure pulses of the present invention may create or cause the dilation of one or more perforations, fractures, or networks of fractures. Dilation of a fracture may be elastic in nature such that as the energy from the pressure pulse dissipates from the formation, a pressure wave propagates along the length of the fracture. The pressure pulses of the present invention may exceed formation fracture gradient in order to create fractures in a subterranean formation or may straddle the formation fracture gradient in order to enhance, dilate, or propagate existing fractures. The pressure pulses may additionally be applied to treatment fluids that have been pre-pressurized above the ambient fluid pressure in the well bore.

The pressure pulses of the present invention may also aid in overcoming the effects of surface tension and capillary pressure within subterranean formations, thus allowing the treatment fluids to penetrate the formation more effectively and with greater uniformity. As the pressure of the treatment fluid dips below the formation fracture gradient, the treatment fluid may be able to enter the formation along the just-created or -enhanced fractures, thereby significantly increasing the surface area of the formation contacted by the treatment fluids.

In some embodiments, the present invention provides methods of providing a jetting fluid comprising an aqueous base fluid; providing a fracturing fluid comprising an aqueous base fluid, a gelling agent, a proppant agent, a gas generating chemical, and a gas activator; introducing the jetting fluid into a subterranean formation to create or enhance at least one fracture therein; then, introducing the fracturing fluid into the at least one fracture; then, applying intermittent pressure pulsing to the fracturing fluid to extend the at least one fracture.

The treatment fluids (e.g., jetting fluid and fracturing fluid) of the present invention may be injected into a subterranean formation as part of a stimulation operation, such as hydraulic fracturing. As used herein, the term "treatment fluid" may generally refer to any subterranean fluid used for subterranean operations that does not interfere substantially with the ability to generate foam. The treatment fluids of the present invention may also be used to create, enhance, or propagate at least one fracture in a subterranean formation. A person of ordinary skill in the art will appreciate that the treatment fluids of the present invention may also be used in non-fracturing operations.

In some embodiments, the present invention provides a method comprising providing a jetting fluid comprising an aqueous base fluid; providing a first fracturing fluid comprising an aqueous base fluid, a gelling agent, a proppant agent, a gas generating chemical, and a gas activator; providing a second fracturing fluid comprising an aqueous base fluid, a foaming agent, and a foam stabilizing surfactant; introducing the jetting fluid into a subterranean formation to create or enhance at least one fracture therein; introducing the first fracturing fluid into the at least one fracture; applying intermittent pressure pulsing to the first fracturing fluid to extend the at least one fracture; and introducing the second fracturing fluid between the intermittent pressure pulsing of the first fracturing fluid.

In some embodiments, the treatment fluids of the present invention are introduced into a subterranean formation using traditional pumping equipment (e.g., fracturing pumps). In other embodiments, the treatment fluids may be introduced using a hydrajetting tool having at least one fluid jet-forming nozzle. In those embodiments in which a hydrajetting tool is used, it may be repositioned at different intervals within a subterranean formation in order to repeat the steps of the present invention including introducing the first or second fracturing fluid and applying pressure pulsing. One of ordinary skill in the art, with the benefit of this disclosure, will recognize what pumping equipment is appropriate for a particular application.

I. Aqueous Base Fluid

Aqueous base fluids suitable for use in the present invention may comprise fresh water, saltwater (e.g., water containing one or more salts dissolved therein), brine (e.g., saturated salt water), seawater, produced water, flow back water, or any combinations thereof. Generally, the water may be from any source, provided that it does not contain components that might adversely affect the stability and/or performance of the treatment fluids of the present invention. Because the relatively simple chemistries and high tolerances for salt and temperature of the treatment fluids of the present invention, the aqueous base fluids may be from contaminated water sources (e.g., produced water, flow back water), which may be advantageous.

In certain embodiments, the pH of the aqueous base fluid may be adjusted (e.g., by a buffer or other pH adjusting agent). In these embodiments, the pH may be adjusted to a specific level, which may depend on, among other factors, the types of additives included in the treatment fluid. Additives suitable for use in the present invention may include, but are not limited to, viscosifying agents, buffering agents, pH adjusting agents, biocides, bactericides, friction reducers, solubilizer, or any combinations thereof. One of ordinary skill in the art, with the benefit of this disclosure, will recognize when such pH adjustments or additives are appropriate.

II. Proppant Agent

Proppant agents suitable for use in the present invention may comprise any material suitable for use in subterranean operations. Suitable materials include, but are not limited to, cutting sand, sand, bauxite, ceramic materials, glass materials, polymer materials, polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, and any combinations thereof. Suitable composite particulates may comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and any combinations thereof. The mean proppant agent size generally may range from about 2-mesh to about 800-mesh on the U.S. Sieve Series; however, in certain circumstances, other mean proppant agent sizes may be desired and will be entirely suitable for practice of the present invention. In particular embodiments, preferred mean proppant agent size distribution ranges are one or more of 6/12, 8/16, 12/20, 16/30, 20/40, 30/50, 40/60, 40/70, or 50/70 mesh. It should be understood that the term "proppant agent," as used herein, includes all known shapes of materials, including substantially spherical materials, fibrous materials, polygonal materials (such as cubic materials), and any combinations thereof. In certain embodiments, the proppant agents may be present in the fracturing fluids of the present invention in an amount in the range of from about 0.1 pounds per gallon ("ppg") to about 30 ppg by volume of the fracturing fluid, preferably from about 0.5 ppg to about 15 ppg, and more preferably from about 1.0 ppg to 10 ppg. Fibrous materials, that may or may not be used to bear the pressure of a closed fracture, may be included in certain embodiments of the present invention.

III. Cutting Particulate

In some embodiments, the jetting fluids of the present invention may further comprise a cutting particulate. The cutting particulate may be used to aid in fracturing the subterranean formation. Typically, cutting particulates may be present in the jetting fluids in the initial creation of a slot or perforation. In some cases, however, slot or perforation may be created using a jetting fluid alone, without cutting particulates. The cutting particulates of the present invention may be any abrasive proppant agent disclosed herein or any abrasive cutting agent suitable for fracturing operations known in the art. In preferred embodiments of the present invention, the cutting particulate in the jetting fluid is present in a low concentration. Suitable cutting particulates include, but are not limited to, natural sand, manmade proppant, mineral salts (e.g. calcium borate and borax), and any combinations thereof. Additional cutting particulates suitable for use in the present invention include those described in U.S. Pat. No. 5,366,015, the entire disclosure of which is hereby incorporated by reference. In some embodiments, the cutting particulate is present in the jetting fluid of the present invention in an amount in the range of from about 0.05 ppg to about 3 ppg by volume of the jetting fluid, preferably from about 0.1 ppg to about 2 ppg, and more preferably from about 0.4 ppg to about 1 ppg.

IV. Gelling Agent

The gelling agents suitable for use in the present invention may comprise any substance (e.g., a polymeric material) capable of increasing the viscosity of the treatment fluid. In certain embodiments, the gelling agent may comprise one or more polymers that have at least two molecules that are capable of forming a crosslink in a crosslinking reaction in the presence of a crosslinking agent, and/or polymers that have at least two molecules that are so crosslinked (i.e., a crosslinked gelling agent). The gelling agents may be naturally-occurring gelling agents, synthetic gelling agents, or a combination thereof. The gelling agents also may be cationic gelling agents, anionic gelling agents, or a combination thereof. Suitable gelling agents include, but are not limited to, polysaccharides, biopolymers, and/or derivatives thereof that contain one or more of these monosaccharide units: galactose, mannose, glucoside, glucose, xylose, arabinose, fructose, glucuronic acid, or pyranosyl sulfate. Examples of suitable polysaccharides include, but are not limited to, guar gums (e.g., hydroxyethyl guar, hydroxypropyl guar, carboxymethyl guar, carboxymethylhydroxyethyl guar, and carboxymethylhydroxypropyl guar ("CMHPG")), cellulose derivatives (e.g., hydroxyethyl cellulose, carboxyethylcellulose, carboxymethylcellulose, and carboxymethylhydroxyethylcellulose), xanthan, scleroglucan, succinoglycan, diutan, and any combinations thereof. In certain embodiments, the gelling agents comprise an organic carboxylated polymer, such as CMHPG.

Suitable synthetic polymers include, but are not limited to, 2,2'-azobis(2,4-dimethyl valeronitrile), 2,2'-azobis(2,4-dimethyl-4-methoxy valeronitrile), polymers and copolymers of acrylamide ethyltrimethyl ammonium chloride, acrylamide, acrylamido- and methacrylamido-alkyl trialkyl ammonium salts, acrylamidomethylpropane sulfonic acid, acrylamidopropyl trimethyl ammonium chloride, acrylic acid, dimethylaminoethyl methacrylamide, dimethylaminoethyl methacrylate, dimethylaminopropyl methacrylamide, dimethylaminopropylmethacrylamide, dimethyldiallylammonium chloride, dimethylethyl acrylate, fumaramide, methacrylamide, methacrylamidopropyl trimethyl ammonium chloride, methacrylamidopropyldimethyl-n-dodecylammonium chloride, methacrylamidopropyldimethyl-n-octylammonium chloride, methacrylamidopropyltrimethylammonium chloride, methacryloylalkyl trialkyl ammonium salts, methacryloylethyl trimethyl ammonium chloride, methacrylylamidopropyldimethylcetylammonium chloride, N-(3-sulfopropyl)-N-methacrylamidopropyl-N,N-dimethyl ammonium betaine, N,N-dimethylacrylamide, N-methylacrylamide, nonylphenoxypoly(ethyleneoxy)ethylmethacrylate, partially hydrolyzed polyacrylamide, poly 2-amino-2-methyl propane sulfonic acid, polyvinyl alcohol, sodium 2-acrylamido-2-methylpropane sulfonate, quaternized dimethylaminoethylacrylate, quaternized dimethylaminoethylmethacrylate, any derivatives thereof, and any combinations thereof. In certain embodiments, the gelling agent comprises an acrylamide/2-(methacryloyloxy)ethyltrimethylammonium methyl sulfate copolymer. In certain embodiments, the gelling agent may comprise an acrylamide/2-(methacryloyloxy)ethyltrimethylammonium chloride copolymer. In certain embodiments, the gelling agent may comprise a derivatized cellulose that comprises cellulose grafted with an allyl or a vinyl monomer, such as those disclosed in U.S. Pat. Nos. 4,982,793, 5,067,565, and 5,122,549, the entire disclosures of which are incorporated herein by reference.

Additionally, polymers and copolymers that comprise one or more functional groups (e.g., hydroxyl, cis-hydroxyl, carboxylic acids, derivatives of carboxylic acids, sulfate, sulfonate, phosphate, phosphonate, amino, or amide groups) may be used as gelling agents.

The gelling agent may be present in the treatment fluids useful in the methods of the present invention in an amount sufficient to provide the desired viscosity. In some embodiments, the gelling agents may be present in an amount in the range of from about 0.1% to about 10% by weight of the treatment fluid. In certain preferred embodiments, the gelling agents may be present in an amount in the range of from about 0.15% to about 2.5% by weight of the treatment fluid.

In those embodiments of the present invention where it is desirable to crosslink the gelling agent, the treatment fluids may comprise one or more crosslinking agents. The crosslinking agents may comprise a borate ion, a metal ion, or similar component that is capable of crosslinking at least two molecules of the gelling agent. Examples of suitable crosslinking agents include, but are not limited to, borate ions, magnesium ions, zirconium IV ions, titanium IV ions, aluminum ions, antimony ions, chromium ions, iron ions, copper ions, magnesium ions, and zinc ions. These ions may be introduced into the treatment fluids by providing any compound that is capable of producing one or more of these ions. Examples of such compounds include, but are not limited to, ferric chloride, boric acid, disodium octaborate tetrahydrate, sodium diborate, pentaborates, ulexite, colemanite, magnesium oxide, zirconium lactate, zirconium triethanol amine, zirconium lactate triethanolamine, zirconium carbonate, zirconium acetylacetonate, zirconium malate, zirconium citrate, zirconium diisopropylamine lactate, zirconium glycolate, zirconium triethanol amine glycolate, zirconium lactate glycolate, titanium lactate, titanium malate, titanium citrate, titanium ammonium lactate, titanium triethanolamine, and titanium acetylacetonate, aluminum lactate, aluminum citrate, antimony compounds, chromium compounds, iron compounds, copper compounds, zinc compounds, and any combinations thereof. In certain embodiments of the present invention, the crosslinking agent may be formulated to remain inactive until it is "activated" by, among other things, certain conditions in the fluid (e.g., pH, temperature, etc.) and/or interaction with some other substance. In some embodiments, the activation of the crosslinking agent may be delayed by encapsulation with a coating (e.g., a porous coating through which the crosslinking agent may diffuse slowly, or a degradable coating that degrades downhole) that delays the release of the crosslinking agent until a desired time or place. The choice of a particular crosslinking agent will be governed by several considerations that will be recognized by one skilled in the art, including but not limited to the following: the type of gelling agent included, the molecular weight of the gelling agent(s), the conditions in the subterranean formation being treated, the safety handling requirements, the pH of the treatment fluid, temperature, and/or the desired delay for the crosslinking agent to crosslink the gelling agent molecules.

When included, suitable crosslinking agents may be present in the treatment fluids useful in the methods of the present invention in an amount sufficient to provide the desired degree of crosslinking between molecules of the gelling agent. In certain embodiments, the crosslinking agent may be present in the treatment fluids of the present invention in an amount in the range of from about 0.005% to about 1% by weight of the treatment fluid. In certain preferred embodiments, the crosslinking agent may be present in the treatment fluids of the present invention in an amount in the range of from about 0.05% to about 1% by weight of the treatment fluid. One of ordinary skill in the art, with the benefit of this disclosure, will recognize the appropriate amount of crosslinking agent to include in a treatment fluid of the present invention based on, among other things, the temperature conditions of a particular application, the type of gelling agents used, the molecular weight of the gelling agents, the desired degree of viscosification, and/or the pH of the treatment fluid.

V. Gas Generating Chemical

The gas generating chemicals suitable for use in the present invention may include any gas generating chemical provided that it does not adversely affect the stability and/or performance of the treatment fluids of the present invention. The gas generating chemicals are generally solid materials that either self-generate gas or are capable of liberating gas upon activation. In preferred embodiments, the gas generating chemicals of the present invention primarily generate nitrogen and may also generate ammonia, an acidic gas (e.g., carbon dioxide), and carbon monoxide depending on the chemical structure of the gas generating chemical (e.g., amide groups) and the gas activator used.

Suitable gas generating chemicals for use in the present invention may include, but are not limited to ammonium salts of organic acids, ammonium salts of inorganic acids, hydroxylamine sulfate, carbamide, compounds containing hydrazine or azo groups, including hydrazine, azodicarbonamide, azobis (isobutyronitrile), p-toluene sulfonyl hydrazide, p-toluene sulfonyl semicarbazide, carbohydrazide, p-p' oxybis (benzenesulfonylhydrazide), and mixtures thereof. In preferred embodiments, the gas generating chemical is selected from azodicarbonamide or carbohydrazide.

In certain embodiments, the gas generating chemicals may be present in the treatment fluids of the present invention in an amount in the range of from about 0.1% to about 10% by weight of the treatment fluid. In certain preferred embodiments, the gas generating chemicals may be present in the treatment fluids of the present invention in an amount in the range of from about 0.5% to about 3% by weight of the treatment fluid. One of ordinary skill in the art, with the benefit of this disclosure, will recognize the appropriate amount of gas generating chemicals to include in a treatment fluid of the present invention based on, among other things, the type of gas activator used, the temperature conditions of a particular formation, the molecular weight of the gas generating chemicals, the desired degree of foam production, and/or the pH of the treatment fluid.

VI. Gas Activator

In order to cause the gas generating chemicals of the present invention to generate gases, a gas activator is included in the treatment fluids of the present invention. The gas generating chemical and gas activator interact such that the gas generating chemical releases gas to aerate the treatment fluid (e.g., create foam). Suitable gas activators include, but are not limited to alkali materials, salts of alkali metals and alkaline earth metals, oxidizing agents of alkali metals and alkaline earth metal salts, and any combinations thereof. Nonlimiting examples of suitable alkaline materials include, but are not limited to, carbonate, hydroxide, and oxide, and any combinations thereof. Nonlimiting examples of suitable salts of alkali metals and alkaline earth metals, include, but are not limited to lithium, sodium, magnesium, calcium, and any combinations thereof. Nonlimiting examples of suitable oxidizing agents of alkali metals and alkaline earth metal salts of, for example, peroxide, persulfate, perborate, hypochlorite, hypobromite, chlorite, chlorate, iodate, bromate, chloroaurate, arsenate, antimonite, molybate anions, include, but are not limited to, ammonium persulfate, sodium persulfate, potassium persulfate, sodium chloride, sodium chlorate, hydrogen peroxide, sodium perborate, sodium peroxy carbonate, and any combinations thereof.

The gas activators of the present invention may additionally be encapsulated in order to delay their reaction with the gas generating chemicals. The encapsulation of the delayed encapsulated gas activators may be designed to breakdown or degrade in response to, for example, time or subterranean conditions, such as temperature or pressure. The gas activators of the present invention may be encapsulated by any known material capable of breaking down under known conditions provided that it does not contain components that might adversely affect the stability and/or performance of the treatment fluids of the present invention. Suitable encapsulating materials include, but are not limited to, waxes, drying oils such as tung oil and linseed oil, polyurethanes, crosslinked partially hydrolyzed polyacrylics, and any combinations thereof. Encapsulating materials may be applied to the gas activators by any known method suitable for the encapsulating material used, such as spray coating, for example.

In certain embodiments, the gas activators may be present in the treatment fluids of the present invention in an amount in the range of from about 0.1% to about 5% by weight of the treatment fluid. In certain preferred embodiments, the gas activators may be present in the treatment fluids of the present invention in an amount in the range of from about 0.1% to about 2% by weight of the treatment fluid. One of ordinary skill in the art, with the benefit of this disclosure, will recognize the appropriate amount of gas activators to include in a treatment fluid of the present invention based on, among other things, the type of gas generating chemical used, the temperature conditions of a particular formation, the molecular weight of the gas activators, the desired degree of foam production, and/or the pH of the treatment fluid.

VII. Foaming Agent and Foam Stabilizing Surfactant

In some embodiments, the present invention provides a method comprising providing a jetting fluid comprising an aqueous base fluid; providing a first fracturing fluid comprising an aqueous base fluid, a gelling agent, a proppant agent, a gas generating chemical, and a gas activator; providing a second fracturing fluid comprising an aqueous base fluid, a foaming agent, and a foam stabilizing surfactant; introducing the jetting fluid into a subterranean formation to create or enhance at least one fracture therein; introducing the first fracturing fluid into the at least one fracture; applying intermittent pressure pulsing to the first fracturing fluid to extend the at least one fracture; and introducing the second fracturing fluid between the intermittent pressure pulsing of the first fracturing fluid.

Suitable foaming agents for use in conjunction with the present invention may include, but are not limited to, cationic foaming agents, anionic foaming agents, amphoteric foaming agents, nonionic foaming agents, or any combination thereof. Nonlimiting examples of suitable foaming agents may include, but are not limited to, surfactants like betaines, sulfated or sulfonated alkoxylates, alkyl quarternary amines, alkoxylated linear alcohols, alkyl sulfonates, alkyl aryl sulfonates, C10-C20 alkyldiphenyl ether sulfonates, polyethylene glycols, ethers of alkylated phenol, sodium dodecylsulfate, alpha olefin sulfonates such as sodium dodecane sulfonate, trimethyl hexadecyl ammonium bromide, and the like, any derivative thereof, or any combination thereof. Foaming agents may be included in treatment fluids of the present invention at concentrations ranging typically from about 0.05% to about 2% of the liquid component by weight.

Any foam stabilizing surfactant compatible with the foaming agent and capable of stabilizing the foamed treatment fluids of the present invention may be. Such foam stabilizing surfactants include, but are not limited to, ethoxylated alcohol ether sulfate surfactant, alkyl amidopropylbetanine surfactant, alkyl amidopropyldiethylamine oxide surfactant, alkene amidopropylbetaine surfactant, alkene amidopropyldimethylamine oxide surfactant, and any combinations thereof. The surfactant or surfactants that may be used are included in the treatment fluids of the present invention in an amount in the range of about 0.01% to about 2% of the liquid component by weight.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method comprising:

a) providing a jetting fluid comprising an aqueous base fluid;

b) providing a fracturing fluid comprising an aqueous base fluid, a gelling agent, a proppant agent, a gas generating chemical, and a gas activator;

c) introducing the jetting fluid into a subterranean formation to create or enhance at least one fracture therein;

d) introducing the fracturing fluid into the at least one fracture, wherein prior to introducing the fracturing fluid into the at least one fracture, the fracturing fluid is pre-pressurized above an ambient fluid pressure of the subterranean formation; and e) applying intermittent pressure pulsing to the fracturing fluid to extend the at least one fracture and to deposit the proppant agent therein.

2. The method of claim 1 wherein steps c) through e) are repeated in order to create or enhance multiple fractures and to deposit the proppant agent within the multiple fractures in the subterranean formation.

3. The method of claim 1 wherein the jetting fluid further comprises a cutting particulate.

4. The method of claim 3 wherein the cutting particulate is present in the jetting fluid in an amount from about 0.05 ppg to about 3 ppg by volume of the jetting fluid.

5. The method of claim 1 wherein the gelling agent is selected from the group consisting of naturally-occurring cationic gelling agents, naturally-occurring anionic gelling agents, synthetic cationic gelling agents, synthetic anionic gelling agents, and any combination thereof.

6. The method of claim 1 wherein the fracturing fluid further comprises a crosslinking agent selected from the group consisting of a borate ion, a metal ion, and any combination thereof.

7. The method of claim 1 wherein the gas generating chemical is selected from the group consisting of ammonium salts of organic acids, ammonium salts of inorganic acids, hydroxylamine sulfate, carbamide, compounds containing hydrazine, compounds containing azo groups, and any combination thereof.

8. The method of claim 1 wherein the gas activator is selected from the group consisting of alkali materials, salts of alkali metals, salts of alkaline earth metals, oxidizing agents of alkali metal salts, oxidizing agents of alkaline earth metal salts, and any combination thereof.

9. The method of claim 1 wherein the gas activator is encapsulated in an encapsulating material.

10. The method of claim 1 wherein the jetting fluid or the fracturing fluid further comprises an additive selected from the group consisting of viscosifying agents, buffering agents, pH adjusting agents, biocides, bactericides, friction reducers, solubilizer, and any combination thereof.

11. The method of claim 1 wherein the jetting fluid further comprises a cutting particulate.

12. The method of claim 11 wherein the cutting particulate is present in the jetting fluid in an amount from about 0.05 ppg to about 3 ppg by volume of the jetting fluid.

13. A method comprising:

a) providing a jetting fluid comprising an aqueous base fluid;

b) providing a fracturing fluid comprising an aqueous base fluid, a gelling agent, a proppant agent, a gas generating chemical, a gas activator, a foaming agent, and a foam stabilizing surfactant;

c) introducing the jetting fluid into a subterranean formation to create or enhance at least one fracture therein;

d) introducing the fracturing fluid into the at least one fracture, wherein prior to introducing the fracturing fluid into the at least one fracture, the fracturing fluid is pre-pressurized above an ambient fluid pressure of the subterranean formation; and e) applying intermittent pressure pulsing to the fracturing fluid to extend the at least one fracture.

14. The method of claim 13 wherein steps c) through e) are repeated in order to create or enhance multiple fractures and to deposit the proppant agent within the multiple fractures in the subterranean formation.

15. The method of claim 13 wherein the gas activator is encapsulated in an encapsulating material.

16. The method of claim 13 wherein the foaming agent is selected from the group consisting of cationic foaming agents, anionic foaming agents, amphoteric foaming agents, nonionic foaming agents, and any combination thereof.

17. The method of claim 13 wherein the foam stabilizing surfactants is selected from the group consisting of ethoxylated alcohol ether sulfate surfactant, alkyl amidopropylbetanine surfactant, alkyl amidopropyldiethylamine oxide surfactant, alkene amidopropylbetaine surfactant, alkene amidopropyldimethylamine oxide surfactant, and any combinations thereof.

18. A method comprising:

a) providing a jetting fluid comprising an aqueous base fluid;

b) providing a first fracturing fluid comprising an aqueous base fluid, a gelling agent, a proppant agent, a gas generating chemical, and a gas activator;

c) providing a second fracturing fluid comprising an aqueous base fluid, a foaming agent, and a foam stabilizing surfactant;

d) introducing the jetting fluid into a subterranean formation to create or enhance at least one fracture therein;

e) introducing the first fracturing fluid into the at least one fracture;

f) applying intermittent pressure pulsing to the first fracturing fluid to extend the at least one fracture; and g) introducing the second fracturing fluid between the intermittent pressure pulsing of the first fracturing fluid.

19. The method of claim 18 wherein steps d) through g) are repeated in order to create or enhance multiple fractures and to deposit the proppant agent within the multiple fractures in the subterranean formation.

20. The method of claim 18 wherein the gas activator is encapsulated in an encapsulating material.

* * * * *